United States Patent [19]

German et al.

[11] Patent Number: 4,762,558

[45] Date of Patent: Aug. 9, 1988

[54] PRODUCTION OF REACTIVE SINTERED NICKEL ALUMINIDE MATERIAL

[75] Inventors: Randall M. German, Latham; Animesh Bose, Troy, both of N.Y.; David Sims, Bonners Ferry, Id.

[73] Assignee: Rensselaer Polytechnic Institute, Troy, N.Y.

[21] Appl. No.: 50,914

[22] Filed: May 15, 1987

[51] Int. Cl.[4] ..... B22F 3/00

[52] U.S. Cl. ..... 75/246; 75/249; 419/23; 419/34; 419/45; 419/46; 419/57; 419/58; 419/68; 420/460

[58] Field of Search ..... 75/246, 249; 419/34, 419/45, 68, 46, 23, 57, 58; 420/460

[56] References Cited

U.S. PATENT DOCUMENTS

| | | | |
|---|---|---|---|
| 2,755,184 | 7/1956 | Turner et al. | 420/460 |
| 4,609,528 | 9/1986 | Chang et al. | 75/246 |
| 4,613,368 | 9/1986 | Chang et al. | 75/246 |
| 4,676,829 | 6/1987 | Chang et al. | 75/246 |

*Primary Examiner*—Stephen J. Lechert, Jr.

*Attorney, Agent, or Firm*—McGlew and Tuttle

[57] ABSTRACT

Reactive sintering process for producing a shaped body containing the nickel aluminide compound $Ni_3Al$, which comprises sintering a compacted shaped mass containing an intimate mixture of substances, e.g. including elemental nickel powder and elemental aluminum powder in a stoichiometric atomic ratio generally corresponding to the compound $Ni_3Al$, by heating the mass, e.g. in a vacuum, to an elevated sintering temperature, e.g. 500–750° C., sufficiently to initiate an exothermic reaction, and at a heating rate sufficiently for consequent progressive generation of a transient liquid below the melting point of the aluminum powder and at the corresponding eutectic temperature, and upon initiation of the exothermic reaction continuing the sintering sufficiently to form a densified shaped body containing the nickel aluminide compound $Ni_3Al$, and having a porosity of at most about 8%, or alternatively having an essentially fully densified structure where the heating is carried out under simultaneously applied mechanical pressure for hot isostatic compaction of the compacted shaped mass.

50 Claims, 7 Drawing Sheets

100 μm

20 μm

20 μm

100 μm

100 μm

100 μm

100 μm

PRODUCTION OF REACTIVE SINTERED NICKEL ALUMINIDE MATERIAL

FIELD AND BACKGROUND OF THE INVENTION

The present invention relates to the production of reactive sintered nickel aluminide material, and more particularly to relatively low temperature and short duration reactive sintering under exothermic conditions of a shaped compact containing a powder mixture of elemental nickel and elemental aluminum in a corresponding stoichiometric atomic ratio to form directly the nickel aluminide compound $Ni_3Al$ as a densified intermetallic compound material of relatively low porosity.

Intermetallic compounds are current candidates for use as high temperature, oxidation resistant materials finding application as turbine components, e.g. as turbine blades, etc., since advances in ceramics have failed to live up to expectations whereas those concerning superalloys have apparently been exhausted (see [1] C. C. Koch, C. T. Liu and N. S. Stoloff (eds.), *High-Temperature Ordered Intermetallic Alloys,* Materials Research Society Symposium Proceedings, vol. 39, Materials Research Society, Warrendale, PA, 1985; and [2] N. S. Stoloff, *Inter. Metal Rev.,* 1984, vol. 29, pp. 123–135).

The intermetallic compounds based on aluminum have the attractive characteristics of low density, high strength, good corrosion and oxidation resistance, and relatively low cost. In some cases, the intermetallics exhibit the unique characteristic of improved strength with increasing temperature. Coupled with relatively high melting temperatures, these attributes make for ideal high temperature materials.

Powder metallurgy offers one approach for fabrication of complex shaped, high performance intermetallic compound alloys (see [3] W. M. Schulson, *Inter. J. Powder Met.,* 1987, vol. 23, pp. 25–32; and [4] K. Vedula and J. R. Stephens, *Powder Metallurgy* 1986 *State of the Art,* W. J. Huppmann, W. A. Kaysser and G. Petzow (eds.), Verlag Schmid, Freiburg, West Germany, 1986, pp. 205–214). Powder metallurgy approaches include hot isostatic pressing (HIP), hot extrusion, injection molding and transient liquid phase sintering.

The pertinent prior art in this regard includes many U.S. Patents, as typified by the following.

U.S. Pat. No. 4,140,528 (Hebeisen et al) concerns hot workable nickel-base superalloy fully dense articles made for example by hot isostatic pressing (HIP) at 1900°–2050° F. (1038°–1121° C.) and 15,000 psi of −60 to −80 mesh prealloyed powder that had itself been produced by nitrogen gas atomizing of a molten metal mass of the desired superalloy composition including, besides a predominant content of Ni, small amounts of numerous elements such as Al and B.

U.S. Pat. No. 4,379,720 (Ray et al); U.S. Pat. No. 4,478,791 and U.S. Pat. No 4,606,888 (Huang et al); U.S. Pat. No. 4,609,528, U.S. Pat. No. 4,613,368 and U.S. Pat. No. 4,613,480 (Chang et al); and U.S. Pat. No. 4,612,165 (Liu et al); are directed to analogous additive element containing, especially boron doped, nickel aluminum alloys used as prealloys in powder metallurgy, plasma spraying, and the like.

U.S. Pat. No. 3,084,041 (Zegler et al) teaches the production of the extremely low temperature superconducting niobium tin compound $Nb_3Sn$ of uniform stoichiometric composition, by melting a mixture of niobium powder and tin powder, the latter in excess of the stoichiometrical amount, at 900° C. or higher for 7 hours or longer so as to form a prealloy, followed by solidification cooling, leaching of excess tin with concentrated hydrochloric acid for 12–24 hours and then sintering the $Nb_3Sn$ in an inert atmosphere at 900° C. or higher.

U.S. Pat. No. 3,260,595 (Maier et al) teaches the production of the extremely low temperature superconducting intermetallic compound vanadium-gallium $V_3Ga$, by precursor heating to about 700° C. of a stoichiometrical mixture of vanadium powder and gallium powder, which results in an exothermic reaction causing the formation of needles of the precursor compound $V_2Ga_5$, then grinding the needles to a powder and mixing such powder with additional vanadium powder in a specified stoichiometrical ratio, compressing the powder mixture, vacuum heating the compressed mixture at about 600° C. for 30–60 minutes to remove adsorbed water and hydrogen, and finally sintering the so degassed mass under protective gas at about ½ atmosphere for about an hour at about 1300° C. to produce a sintered body of $V_3Ga$. It is believed clear that one inherent problem with such a technique is gallium vaporization due to its high vapor pressure at temperatures above approximately 1100° C.

U.S. Pat. No. 3,288,571 (Werner et al) teaches the production of pure form nuclear fuel uranium aluminides of the class $UAl_3$ and $UAl_{4.5}$, by heating a stoichiometrical mixture of aluminum and uranium (or uranium hydride) powders to a temperature as dictated by the U-Al system phase diagram to permit interdiffusion of the elements without melting the desired compound, using a hot pressing technique where $UAl_3$ is to be formed.

U.S. Pat. No. 3,353,954 (Williams) concerns the formation of ceramic articles such as nuclear fuel elements, containing in situ intermetallic compounds such as borides, aluminides including NiAl, silicides, etc., as a ceramic matrix for other compounds as diluents such as alumina, etc., by heating under compacting pressure a particular mixture of the ingredients for in situ reaction and interbonding thereof.

U.S. Pat. No. 2,877,113 (Fitzer) concerns the reaction of nickel and aluminum powders in liquid mercury at 370°–750° C. to form an alloyed nickel-aluminum compound containing 17–35% Al such as $NiAl_3$ (as distinguished from $Ni_3Al$) which upon being freed of adhering mercury can be used as a prealloy for sintering to form shaped bodies.

U.S. Pat. No. 3,653,976 (Miller et al) concerns a classic brute force approach for the production of the intermetallic compound nickel aluminide NiAl as a prealloy, by adding aluminum to melted nickel in stoichiometric quantity in an argon atmosphere of 5 psig, which results in an exothermic reaction that increases the furnace temperature from 2800° F. (1538° C.) to about 3100° F. (1704° C.), followed by solidification cooling, powdering and compression sintering of the prealloy in a vacuum to form a shaped body such as a turbine rotor blade.

U.S. Pat. No. 2,755,184 (Turner Jr., et al) concerns compacting and then sintering a powder mixture of the precursor compound NiAl and sufficient metallic nickel to yield the desired compound $Ni_3Al$ at a temperature not substantially in excess of the solidus temperature (2525° F.; 1385° C.) of the compound $Ni_3Al$, i.e. first above the melting point of the nickel such as at 2600°-2650° F. (1427°-1454° C.) for 5-10 minutes and then at 2300°-2550° F. (1260°-1399° C.) for 1-25 hours in a non-oxidizing atmosphere, to permit solid state diffusion, thereby producing $Ni_3Al$ to the exclusion of NiAl. It is stated that mere heating of a mixture of metallic aluminum and metallic nickel in proper atomic proportions does not produce the desired intermetallic compound due to the formation of an oxide scum on the aluminum which prevents reaction thereof with the nickel, and that formation of the compound $Ni_3Al$ requires special technique because of the very restricted area of the nickel-aluminum phase diagram in which the compound exists as a stable phase. It is stated that the produced $Ni_3Al$ sintered compact can be machined, has a high hot strength, is tough and relatively ductile, and can withstand oxidizing temperatures of 1600°-2000° F. (871°-1093° C.) without significant loss due to oxidation.

It is clear from the foregoing that the concept of reactive sintering and similar processes have been applied to the intermetallic formation of several compounds in the past (e.g., see U.S. Pat. No. 2,755,184; U.S. Pat. No. 2,877,113; U.S. Pat. No. 3,084,041; U.S. Pat. No. 3,260,595; U.S. Pat. No. 3,288,571; U.S. Pat. No. 3,353,954; and U.S. Pat. No. 4,613,368, supra). Indeed, the process of combustion synthesis is similar, but involves a greater heat of formation for the compounds (see [5] O. Yamada, Y. Miyamoto and M. Koizumi, *Bull. Amer. Ceramic Soc.*, 1985, vol. 64, pp. 319-321).

However, success in the pertinent formation of $Ni_3Al$ in particular has apparently only been achieved per U.S. Pat. No. 2,755,184 to Turner Jr. et al and only by way of a high temperature treatment of mixed powders of the prealloy NiAl and elemental nickel, with the temperature being in the order of 1300° C., such that the process involved is essentially one of solid state homogenization and not reactive sintering. On the other hand, the production of NiAl per U.S. Pat. No. 2,877,113 to Fitzer involves the reaction of Ni and Al in a mercury amalgam at temperatures as high as e.g. 700° C., which leads to the formation of NiAl powder that is subsequently compacted and sintered at temperatures above 1350° C. Neither of these processes is concerned with the direct production of the $Ni_3Al$ intermetallic compound from mixed elemental powders, and both require substantially high final sintering temperatures.

U.S. Pat. No. 3,084,041 to Zegler et al, U.S. Pat. No. 3,260,595 to Maier, U.S. Pat. No. 3,288,571 to Werner et al, and U.S. Pat. No. 3,353,954 to Williams, are believed to be less pertinent in covering other intermetallic systems such as $Nb_3Sn$, $V_3Ga$, $UAl_3$ and $MoSi_2$, as the case may be. The formation of these other compounds is achieved by processing mixed powders, involving steps of reacting, pulverization or grinding, compaction and sintering, and variations including hot pressing and pressure assisted sintering. In each case, stoichiometry is important and is often achieved using an excess of the more volatile ingredient or intermediate chemical leaching to remove unreacted constituents. Again, these known procedures concerning reactive sintering of intermetallic compounds rely on the reaction to form a compound powder, but use subsequent separate steps to densify the compound.

In recent research on $Ni_3Al$, these various approaches have apparently been abandoned in favor of gas atomization and hot isostatic compaction (see [1] C. C. Koch, C. T. Liu and N. S. Stoloff (eds.), *High-Temperature Ordered Intermetallic Alloys,* supra; [2] N. S. Stoloff, *Inter. Metal Rev.*, supra; [3] W. M. Schulson, *Inter. J. Powder Met.*, supra; and [4] K. Vedula and J. R. Stephens, *Powder Metallurgy* 1986 *State of the Art,* supra). The success of this last noted approach is clearly established, yet there are the considerable drawbacks thereto of long process cycles, high process temperatures and significant attendant expense.

There is a clear need for an approach such as one involving reactive sintering, that circumvents the various explicit and implicit problems associated with the above discussed techniques, and permits use conveniently of commercially available elemental powders, comparatively low processing temperatures and short process cycles, and classic press and sinter technology.

SUMMARY OF THE INVENTION

It is among the objects and advantages of the present invention to overcome the deficiencies and drawbacks of the prior art, and to provide a process for the production of reactive sintered nickel aluminide material, and more particularly a process for relatively low temperature and short duration reactive sintering under exothermic conditions of a selectively shaped compact containing a powder mixture of substances including elemental nickel and elemental aluminum in a corresponding stoichiometric atomic ratio to form directly the nickel aluminide compound $Ni_3Al$ as a densified intermetallic compound material of relatively low porosity, as well as to provide the shaped densified material so produced.

Another object of the present invention is to provide a process of the foregoing type having improved fabricability and reliability, especially to form products possessing I:HI ductility and resistance to embrittlement, without the need for alloying additions, and those which are usable as materials for fabrication of high temperature metal matrix composites, such as a composite prepared with ceramic fibers and the like embedded in an intermetallic matrix.

A further object of the present invention is to provide a process involving reactive sintering, that circumvents the various problems associated with the above discussed techniques heretofore used, and permits utilization conveniently of commercially available elemental powders, comparatively low processing temperatures and short duration process cycles, and classic press and sinter technology in an efficient and economical manner, for producing a desired intermetallic compound of certain elemental constituents directly from the elemental constituents as starting materials and without the need for providing a corresponding preformed compound of such elemental constituents as a starting material.

According to the present invention, a reactive sintering process is advantageously provided for producing a selectively shaped body of the nickel aluminide compound $Ni_3Al$, which comprises sintering a compacted selectively shaped mass containing an intimate mixture of substances, especially including elemental nickel powder and elemental aluminum powder in a stoichiometric atomic ratio generally corresponding to the compound $Ni_3Al$.

According to the main embodiment of the present invention, this is effected by heating the mass in a substantially dry inert atmosphere to an elevated sintering temperature sufficiently high to initiate an exothermic reaction, and at a heating rate sufficiently for consequent progressive generation of a transient liquid below the melting point of the aluminum powder and at the corresponding eutectic temperature, and upon initiation of the exothermic reaction continuing the sintering for a total sintering time of at least about 2 seconds and preferably at most about one half hour, to form a densified shaped body containing the nickel aluminide compound $Ni_3Al$ having a comparatively low porosity of for instance at most about 8%, preferably less than about 8%, more preferably less than about 5%, and especially less than about 3%.

Desirably, the mass is heated to a sintering temperature of preferably at most about 750° C. for efficiency and economy, such as about 500°-750° C., and more preferably about 550°-750° C. or especially 550°-700° C., and a heating rate of at least about 3K/min., and preferably about 3-30 K./min.

The nickel powder is present in an amount of generally about 84.0-88.0% by weight (wt.%), preferably about 84.5-87.5 wt.%, more preferably about 85.5-87.5 wt.%, most preferably about 86.0-87.3 wt.%, and especially about 86.7 wt.%, of the mixture. Generally, the nickel powder is present in a particle size of about 3 μm, and the aluminum powder is present in a particle size of about 3-30 μm, and preferably about 15 μm.

Upon initiation of the exothermic reaction, the sintering is continued for a holding time of especially at most about 10-15 minutes. Advantageously, the inert atmosphere may be a vacuum, dry hydrogen, or dry argon, and is preferably a vacuum.

In accordance with certain features of the process of the present invention, the mass is preliminarily compacted, e.g. cold compacted, at a composition pressure of at least about 100 MPa, and preferably about 300-330 MPa, and the nickel powder and aluminum powder more preferably comprise unmilled particles, or alternatively the nickel powder and aluminum powder less preferably comprise particles which have been mixed and thereafter milled, e.g. for about 10-30 minutes, to form agglomerated clusters.

Optionally, the densified shaped body is recovered and thereafter annealed by heat treatment, e.g. at about 1350° C., in a substantially dry inert atmosphere to homogenize further the corresponding microstructure thereof.

According to one specific embodiment of the present invention, the reactive sintering process for producing a shaped body of the nickel aluminide compound $Ni_3Al$, advantageously comprises sintering a compacted shaped mass of an intimate mixture of unmilled elemental nickel powder in a particle size of less than about 3 μm and unmilled elemental aluminum powder in a particle size of about 15 μm, in a stoichiometric atomic ratio generally corresponding to the compound $Ni_3Al$ and in which the nickel powder is present in an amount of about 85.5-87.5 wt.% of the mixture, by heating the mass in a substantially dry inert atmosphere to an elevated sintering temperature of about 550°-750° C. sufficiently to initiate an exothermic reaction, and at a heating rate of at least 3 K./min. for consequent progressive generation of a transient liquid below the melting point of the aluminum powder and at the corresponding eutectic temperature, and upon initiation of the exothermic reaction continuing the sintering for a total sintering time of at least about 2 seconds and at most about 10-15 minutes, to form a densified shaped body containing the nickel aluminide compound $Ni_3Al$ having a porosity of less than about 8%.

The present invention also contemplates the shaped body so produced by the process, said body containing ordered state $Ni_3Al$ and being slightly ductile and resistant to embrittlement, having an elongation in the range of about 1% without the need for ductility imparting alloying additions.

According to an alternative counterpart embodiment of the present invention, a hot isostatic reactive sintering process is provided for producing a fully dense shaped body of the nickel aluminide compound $Ni_3Al$, which comprises cold isostatically compacting an intimate mixture of the two elemental powders in such stoichiometric atomic ratio, as in the above noted main embodiment, then sealing the compacted shaped mass in a container which has been evacuated to form a sealed container containing the compacted shaped mass under vacuum, and hot isostatically compacting the mass.

This is effected by simultaneously heating, e.g. at about 750° C., and pressing, e.g. at about 100 MPa, the sealed container sufficiently to initiate an exothermic reaction and generate a transient liquid below the melting point of the aluminum powder and at the corresponding eutectic temperature, and upon initiation of the exothermic reaction continuing the heating and pressing sufficiently, e.g. for a holding time of about one half hour, to form an essentially fully densified shaped body containing the nickel aluminide compound $Ni_3Al$.

Broadly, the present invention contemplates a process which comprises sintering a compacted shaped mass of an intimate mixture including powder particles containing nickel, optionally alloyed with secondary constituents, and powder particles of elemental aluminum in a stoichiometric atomic ratio of the nickel and aluminum in the mixture generally corresponding to the compound $Ni_3Al$, by heating the mass in a substantially dry inert negative pressure environment, especially in a vacuum, to an elevated sintering temperature sufficiently to initiate such exothermic reaction and generate such liquid below the melting point of the aluminum and at the corresponding eutectic temperature, and upon initiation of the exothermic reaction continuing the heating sufficiently to form a densified shaped body containing the nickel aluminide compound $Ni_3Al$.

Where the heating is carried out without applying mechanical pressure to the mass, the densified shaped body advantageously has a residual porosity of at most about 8%, and where such heating is carried out under simultaneously applied mechanical pressure for hot isostatic compaction of the mass, an essentially fully densified shaped body advantageously is formed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
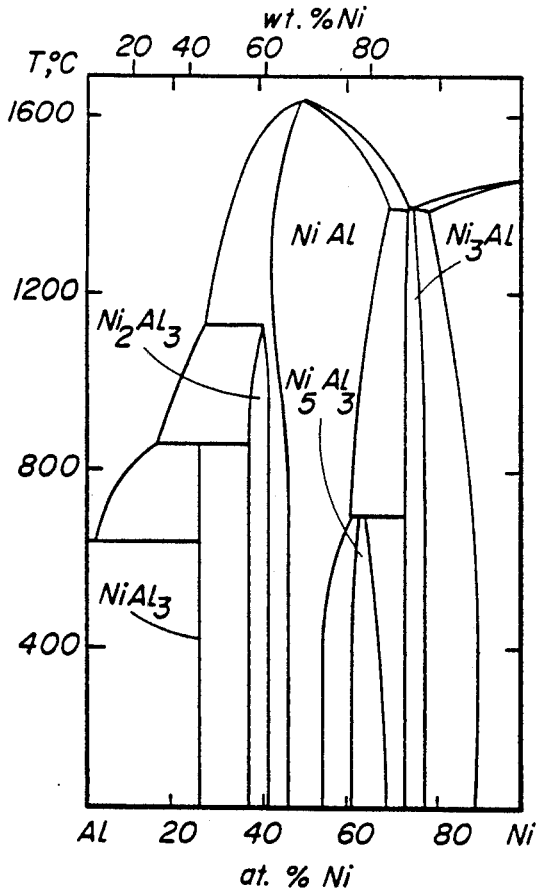
FIG. 1 shows the well known aluminum-nickel binary system phase diagram, with the five intermetallic compounds, i.e. $NiAl_3$, $Ni_2Al_3$, NiAl, $Ni_5Al_3$ and $Ni_3Al$, being noted therein.

By way of background, in general, reactive sintering involves a transient liquid phase (see [6] R. M. German, *Liquid Phase Sintering,* Plenum, New York, NY, 1985, Chapters 7 and 8). The initial compact is composed of mixed powders which are heated to a temperature at which they react to form a compound product. Often, the reaction occurs upon the formation of a first liquid, typically a eutectic liquid at the interface between contacting particles. For instance, in regard to a theoretical binary phase diagram for a reactive sintering system, where a stoichiometric mixture of two elemental powders A and B is used to form an AB intermediate compound product, the reaction occurs above the lowest eutectic temperature in the system, yet at a temperature at which the compound AB is solid (see [7] R. M. German, *J. Metals,* 1986, vol. 38, no. 8, pp. 26–29).

At the lowest eutectic temperature, a transient liquid forms and spreads through the compact during heating. Generally, heat is liberated because of the higher thermodynamic stability of the high melting temperature compound formed. Consequently, reactive sintering is nearly spontaneous once the liquid forms. By appropriate selection of the temperature, particle size, green density and composition, the liquid becomes self-propagating throughout the compact and persists for only a few seconds.

Like other transient liquid phase sintering treatments, the liquid provides a capillary force on the microstructure which leads to densification (see [6] R. M. German, *Liquid Phase Sintering,* supra; [8] W. S. Baek and R. M. German, *Inter. J. Powder Met.,* 1986, vol. 22, pp. 235–244, and [9] *Powder Met. Inter.,* 1985, vol. 17, pp. 273–279; and [10] R. M. German and J. W. Dunlap, *Metall. Trans. A.,* 1986, vol. 17A, pp. 205–213). The liquid is transient since the process is conducted at a temperature below the melting temperature of the compound, typically near the eutectic temperature.

Behavior on reactive sintering has been heretofore investigated (see [11] R. L. Coble, *Sintering—Theory and Practice,* D. Kolar, S. Pejovnik and M. M. Ristic (eds.), Elsevier Scientific, Amsterdam, Netherlands, 1982, pp. 141–151; [12] C. J. Quinn and D. L. Kohlestedt, *J. Mater. Sci.,* 1984, vol. 19, pp. 1229–1241; [13] S. Boskovic, J. L. Gauckler, G. Petzow and T. Y. Tien, *Sintering—Theory and Practice,* D. Kolar, S. Pejovnik and M. M. Ristic (eds.), Elsevier Scientific, Amsterdam, Netherlands, 1982, pp. 374–380; [14] G. R. Twilliger and F. F. Lange, *J. Mater. Sci.,* 1975, vol. 10, pp. 1169–1174; [15] J. P. Hammond and G. M. Adamson, *Modern Developments in Powder Metallurgy,* vol. 3, H. H. Hausner (ed.), Plenum, New York, NY, 1966, pp. 3–25; [16] Y. Miyamoto, M. Koizumi and O. Yamada, *J. Amer. Ceramic Soc.,* 1984, vol. 67, pp. C224–C225; [17] J. Mukerji, P. Greil and G. Petzow, *Sci. Sintering,* 1983, vol. 15, pp. 45–53; and [5] O. Yamada, Y. Miyamoto and M. Koizumi, *Bull. Amer. Ceramic Soc.,* supra).

In this regard, during slow heating, solid state interdiffusion can generate intermetallic phases at the interfaces. Such compounds inhibit the subsequent reaction when the liquid forms. Thus, reactive sintering is sensitive to processing parameters such as heating rates, interfacial quality, green density and particle size. Because of the rapid spreading and reaction of the liquid, pore formation is common, especially in systems with large exotherms. Furthermore, dimensional control often proves difficult if an excess of liquid is formed. Due to such problems, the application of reactive sintering in practice has heretofore been understandably slow.

FIG. 1 shows the aluminum-nickel binary system phase diagram (see [18] M. Hansen and K. Anderko, *Constitution of Binary Alloys,* 2nd ed., McGraw-Hill, New York, NY, 1958; and [19] I. M. Robertson and C. M. Wayman, *Metallog.,* 1984, vol. 17, pp. 43–55). The system is characterized by five intermetallic compounds, of which $Ni_3Al$ is here pertinent. For this system, reactive sintering treatments above the lowest eutectic temperature, i.e. above approximately 640° C., are most appropriate.

Nevertheless, as has been found herein, the temperature range over which reactive sintering is conducted using mixed elemental nickel and aluminum powders to form $Ni_3Al$ is generally slightly higher. Per the present invention, as indicated in the examples below, elemental powders of nickel and aluminum are combined in an intimate mixture at an atomic ratio corresponding to the $Ni_3Al$ intermetallic compound. The powders are used in a small particle size to aid intermixing, optionally milled, and then compressed to create desired good particle-particle contact. This mixture is selectively shaped by die compaction and sintered under precise conditions of atmosphere or environment, heating rate, time and temperature.

During heating, the first aluminum-rich liquid forms at the 640° C. eutectic temperature. This liquid spreads and wets the surrounding nickel, leading to rapid dissolution of the nickel and a concomitant increase in the amount of liquid. Accordingly, as the liquid becomes saturated with nickel, the compound $Ni_3Al$ precipitates as a solid behind the advancing liquid interface.

As to the instant reactive sintering process, the elemental nickel and aluminum powders are randomly intermixed in a stoichiometric ratio ($3Ni+Al \rightarrow Ni_3Al$), such that the particles thereof initially are in point contact. During heating, it is generally considered that with increasing temperature up to the first eutectic temperature, solid state interdiffusion generates some intermetallic compound phases by way of solid state reaction at the points of contact between the nickel and aluminum particles of the admixed elemental powders. However, at the eutectic temperature the first liquid forms and rapidly spreads throughout the structure. The eutectic liquid consumes the elemental powders and forms a precipitated $Ni_3Al$ solid behind the advancing liquid interface. Because the $Ni_3Al$ compound is very stable, it solidifies quickly from the liquid.

Interdiffusion of nickel and aluminum is quite rapid in the liquid phase and the compound generates heat which further accelerates the reaction. Within seconds after reaching the eutectic temperature the mixed powders have reacted, forming the solid compound. Under proper conditions as contemplated herein, the liquid provides sufficient capillary force to densify the structure during the reaction and achieve a final densified compound mass based upon the initial elemental metal powder mixture particles.

By suitable careful control of the sintering reaction, the compound will be nearly fully densified, and in this form may be readily subjected to containerless hot isostatic compaction to full density. Thus, as temperature increases, first a solid state reaction occurs, and subsequently a rapid reaction once the eutectic liquid forms, leading to a final product which constitutes a densified compound.

A particular advantage of the present process is that the produced intermetallic $Ni_3Al$ material has a low final porosity, along with good shape retention and good mechanical properties. Significantly, these attributes are attained without the need for traditional alloying additions such as boron.

The main process parameters involved in the production process of the present invention are (1) particle sizes of the nickel and aluminum powders, respectively, (2) stoichiometry, i.e. Ni wt.%, (3) milling time, (4) green density, i.e. compaction pressure, (5) maximum sintering temperature, (6) heating rate, i.e. K./min., where K. (degrees Kelvin) is stated in degrees Centigrade, (7) atmosphere or environment, and (8) duration of the sintering time, i.e. holding time once the exothermic reaction has been initiated.

According to one specific embodiment of the present invention, the nickel and aluminum powders used for the reactive sintering may be the commercially available INCO type 123 elemental nickel and Valimet type H-15 elemental aluminum, since these powders are relatively pure and have Fisher subsieve size (FSSS) particle sizes near 3 and 15 micrometer, respectively.

It will be noted that the Fisher size is really a surface area measurement, and that in fact the actual particle size of the nickel powder is larger, and as contemplated herein the nickel particle size is preferably operatively equal to or greater than the aluminum particle size in the resulting admixed aluminum and nickel agglomerate particle containing green compact to be subjected to reactive sintering.

The choice of said Valimet powder satisfies the desire to minimize surface oxide on the aluminum, since this is a helium atomized powder.

Although other aluminum particle sizes (e.g. 3, 10, 30 and 95 micrometer) and powder types have been used herein, the combination of said INCO type 123 and Valimet type H-15 powders appears so far to have proved most successful in forming the desired $Ni_3Al$ compound, as noted in the examples hereinbelow. The pertinent characteristics of these two powders are given in Table 1 below.

TABLE 1

| Powder Characteristics | | |
|---|---|---|
| Specification | Nickel | Aluminum |
| Vendor | INCO | Valimet |
| Designation | 123 | H-15 |
| Powder type | carbonyl | gas atomized |
| Purity, % | 99.99 | 99.7 |
| FSSS size, micrometer | 2.8 | 15.0 |
| Apparent density, g/cm$^3$ | 2.2 | — |
| Major impurities, ppm | Ca = 10 | Fe = 1200 |
| | Fe = 30 | volatiles = 200 |

The following Examples, which were carried out in accordance with the procedure discussed hereinafter, as the case may be, and whose results are compiled in Table 2 below, are set forth by way of illustration and not limitation of the present invention.

TABLE 2

| $Ni_3Al$ Reactive Sintering Results | | | | | | | | | | |
|---|---|---|---|---|---|---|---|---|---|---|
| Ex. | Milling min. | Ni wt. % | Heating rate K/min. | Max. temp. °C. | Al particle size μm | Compaction pres. MPa | Atmosphere type | Hold time min. | Sintered density g/cm$^3$ | Porosity % |
| 1* | 0 | 84.0 | 30 | 600 | 10 | 300 | vacuum | 15 | 6.88 | 3.2 |
| 2* | " | 86.0 | " | " | " | " | " | " | 7.18 | 2.8 |
| 3* | " | 86.7 | " | " | " | " | " | " | 7.21 | 3.2 |
| 4* | " | 88.0 | " | " | " | " | " | " | 6.49 | 13.5 |
| 5* | " | 90.0 | " | " | " | " | " | " | 6.56 | 13.8 |
| 6* | " | 84.0 | " | 700 | " | " | " | " | 6.81 | 4.2 |
| 7* | " | 86.0 | " | " | " | " | " | " | 7.23 | 2.2 |
| 8* | " | 86.7 | " | " | " | " | " | " | 7.25 | 3.5 |
| 9* | " | 88.0 | " | " | " | " | " | " | 6.58 | 12.7 |

TABLE 2-continued

| Ni3Al Reactive Sintering Results | | | | | | | | | | |
|---|---|---|---|---|---|---|---|---|---|---|
| Ex. | Milling min. | Ni wt. % | Heating rate K/min. | Max. temp. °C. | Al particle size μm | Compaction pres. MPa | Atmosphere type | Hold time min. | Sintered density g/cm$^3$ | Porosity % |
| 10* | " | 90.0 | " | " | " | " | " | " | 6.56 | 13.8 |
| 11* | " | 86.7 | " | 450 | 3 | " | " | " | 6.90 | 8.0 |
| 12* | " | " | " | " | 10 | " | " | " | 6.67 | 11.1 |
| 13* | " | " | " | " | 30 | " | " | " | 6.81 | 9.2 |
| 14* | " | " | " | " | 95 | " | " | " | 6.45 | 14.0 |
| 15* | " | " | " | 500 | 3 | " | " | " | 7.05 | 6.0 |
| 16* | " | " | " | " | 10 | " | " | " | 7.15 | 4.7 |
| 17* | " | " | " | " | 30 | " | " | " | 7.19 | 4.1 |
| 18* | " | " | " | " | 95 | " | " | " | 6.47 | 13.7 |
| 19* | " | " | " | 550 | 3 | " | " | " | 7.16 | 4.5 |
| 20* | " | " | " | " | 10 | " | " | " | 7.26 | 3.2 |
| 21* | " | " | " | " | 30 | " | " | " | 7.25 | 3.3 |
| 22* | " | " | " | " | 95 | " | " | " | 6.85 | 8.7 |
| 23* | " | " | " | 600 | 3 | " | " | " | 7.15 | 4.7 |
| 24* | " | " | " | " | 10 | " | " | " | 7.21 | 3.9 |
| 25* | " | " | " | " | 30 | " | " | " | 7.25 | 3.3 |
| 26* | " | " | " | " | 95 | " | " | " | 6.81 | 9.2 |
| 27* | " | " | " | 700 | 3 | " | " | " | 7.12 | 5.1 |
| 28* | " | " | " | " | 10 | " | " | " | 7.25 | 3.3 |
| 29* | " | " | " | " | 30 | " | " | " | 7.22 | 3.7 |
| 30* | " | " | " | " | 95 | " | " | " | 6.80 | 9.3 |
| 31** | " | " | 3 | 750 | 15 | 330 | " | 10 | 7.31 | 2.5 |
| 32** | " | " | 30 | " | " | " | " | " | 7.30 | 2.7 |
| 33** | 10 | " | 3 | " | " | " | " | " | 7.15 | 4.7 |
| 34** | " | " | 30 | " | " | " | " | " | 7.29 | 2.8 |
| 35** | 30 | " | 3 | " | " | " | " | " | 6.43 | 14.3 |
| 36** | " | " | 30 | " | " | " | " | " | 7.16 | 4.5 |
| 37** | 0 | " | 3 | " | " | " | H | " | 4.05 | 46. |
| 38** | " | " | 30 | " | " | " | " | " | 7.23 | 3.6 |
| 39** | " | " | 3 | " | " | " | Ar | " | 3.98 | 47. |
| 40** | " | " | 30 | " | " | " | " | " | 6.98 | 6.9 |

*compaction pressure = 300 MPa; holding time = 15 min.
**compaction pressure = 330 MPa; holding time = 10 min.

It will be noted that Examples 8 and 28 are the same, and that Examples 1–30 were carried out at a slightly lower compaction pressure and a longer holding time than in the case of Examples 31–40. All but Examples 33–36 were carried out without milling of the powders, and all but Examples 38–40 were carried out in a vacuum environment, with Examples 37–38 being carried out in a dry hydrogen atmosphere and Examples 39–40 being carried out in a dry argon atmosphere.

By way of procedure, using an Impandex turbula mixer, the two powders (per Table 1, or modified only as to the Al particle size in the case of 3, 10, 30 and 95 μm Al) were mixed for 30 minutes in some cases in a stoichiometric ratio (86.7 wt.% Ni), and in other cases at other ratios (from 84.0 to 90.0 wt.%) to vary the Ni:Al stoichiometry. Various milling times were also applied to the mixed powders, by treatment in a high intensity vibratory mill. Specifically, a Spex mill was used to attain small scale mechanical alloying in short times.

Figure 2A:
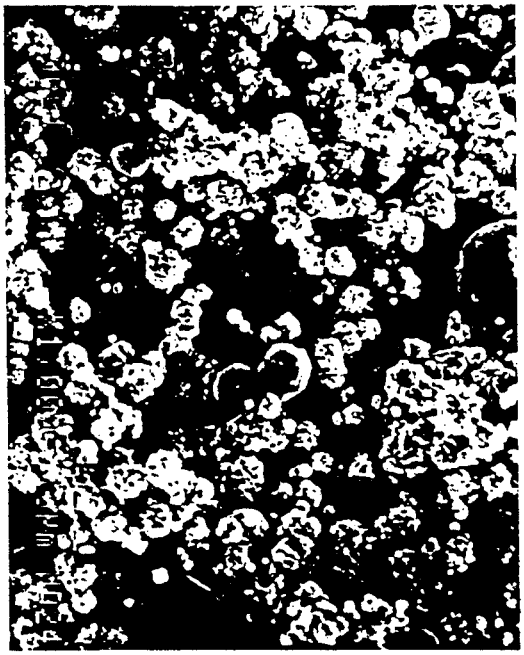
FIGS. 2*a* and 2*b* are scanning electron micrographs of the mixed aluminum and nickel unmilled powders (a), and the mixed powders after intensive milling for 30 minutes (b), respectively, both based upon initially unmilled 3 micrometer (3 μm) Ni powder and 15 micrometer (15 μm) Al powder, shown at a scale of 20 μm.
Figure 2B:
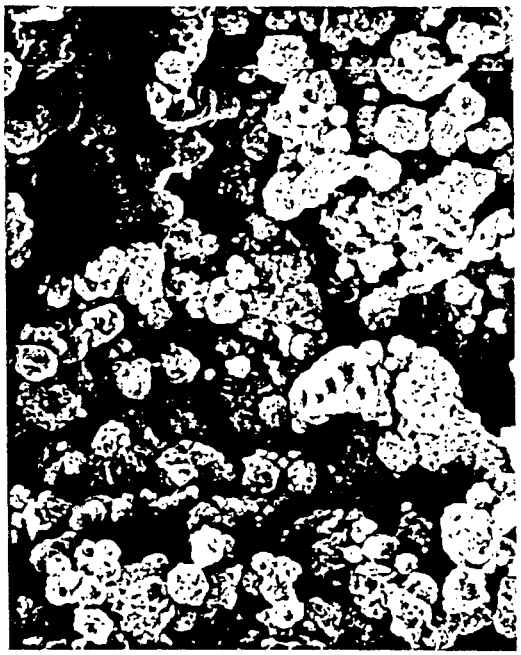

FIG. 2*a* shows the powders after mixing, and FIG. 2*b* shows the mixed powders after high intensity milling for 30 minutes. As a result of the milling, the nickel is spiky and agglomerated, giving clusters over 20 micrometers in size. Clearly, high intensity milling caused agglomeration of the nickel and aluminum, increasing the apparent particle size and disrupting the aluminum.

The resulting powder was compacted, i.e. by cold compaction, into 12 mm diameter compacts of approximately 6 mm height using a compaction pressure ranging from 118 to 400 MPa, and particularly per Examples 1–40 at a compaction pressure of 300 or 330 MPa, with zinc stearate as a die wall lubricant, giving green densities near 70% of theoretical, especially at a compaction pressure of 300 or 330 MPa. Other compact geometries utilized included standard transverse rupture and flat tensile bar specimens.

Figure 3:
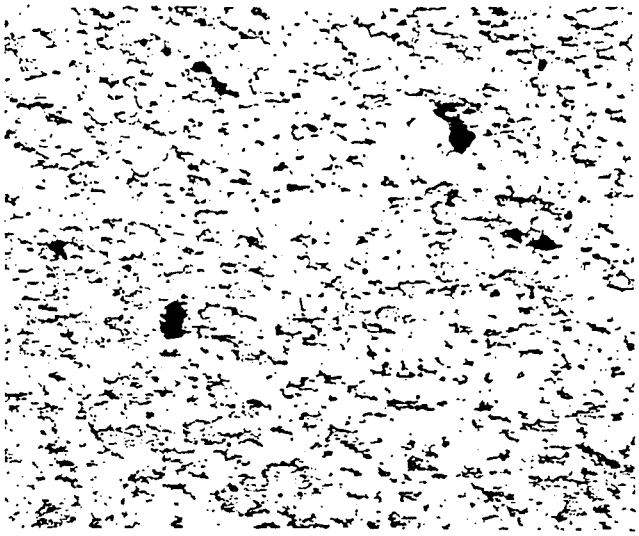
FIG. 3 is an optical micrograph of a green compact of mixed nickel and aluminum powders prior to reaction, based upon 3 μm Ni powder and 15 μm Al powder, shown at a scale of 100 μm.

FIG. 3 shows an optical micrograph taken of such a green compact, illustrating the intermixed nickel and aluminum powders prior to reactive sintering. It will be noted that the aluminum particle size of 15 micrometer is smaller than the nickel agglomerate size, i.e. consequent the 30 minute mixing treatment.

Sintering was performed in a horizontal laboratory tube furnace capable of obtaining 1500° C. temperatures (and accommodating several types of atmospheres, including vacuum, dry hydrogen and dry argon). Typically, the specimens were loaded into an alumina crucible and inserted into a cold furnace. For vacuum sintering a pressure of $7\times10^{-3}$ Pa was typically used. Variations in the heating rate and maximum sintering temperature were tested using either manual or automatic controls. The actual sample temperature was not measured, although parallel differential thermal analysis (see FIG. 12) indicates considerable self-heating during sintering. From the reaction enthalpy and heat capacity the maximum self-heating is estimated at 150 K. Through several experiments it was determined that temperatures from 550° to 750° C. for sintering times from 10 to 15 minutes gave nearly full density. Indeed, higher temperatures in some cases gave lower densities, which is most probably attributable to entrapped gas effects.

After sintering, the samples were furnace cooled. Some material was additionally heat treated at 1350° C. for one hour in dry argon to further homogenize the microstructure.

In a typical case, the fabrication process used herein for reactive sintering to form $Ni_3Al$ containing shaped bodies included the key steps and appropriate variables of mixing 3 μm Ni powder and 15 μm aluminum powder in a ratio of generally about 87 wt.% Ni and 13 wt.% Al for 30 minutes, milling the mixed powders for 0 to 30 minutes, subjecting the mixture in a selectively shaped die to a compaction pressure of for instance 330 MPa, sintering the thereby formed and selectively shaped green compact in the tube furnace at for instance 750° C., based on a heating rate of for instance 30° C./min. starting from a cold furnace, and upon furnace cooling recovering the shaped body of the $Ni_3Al$ intermetallic compound as a typically 97% dense material. Based on the overall results, it is believed that the milling step may be desirably eliminated to achieve a more favorable product at optimum process efficiency.

Measurements of the product consisted of shrinkage, densification, density, hardness, bend strength, tensile strength and tensile elongation. Additionally, fracture surfaces were examined using scanning electron microscopy. X-ray diffraction and transmission electron microscopy were applied to the samples for phase identification and to determine ordering, and electron microprobe analysis was conducted to identify the phases and pores present after reactive sintering. Dilatometry and differential thermal analysis were employed to identify reaction temperatures and assess the speed of the reaction. In all cases, these analyses were performed using standard procedures typically with computer interfaced data acquisition.

Figure 4:
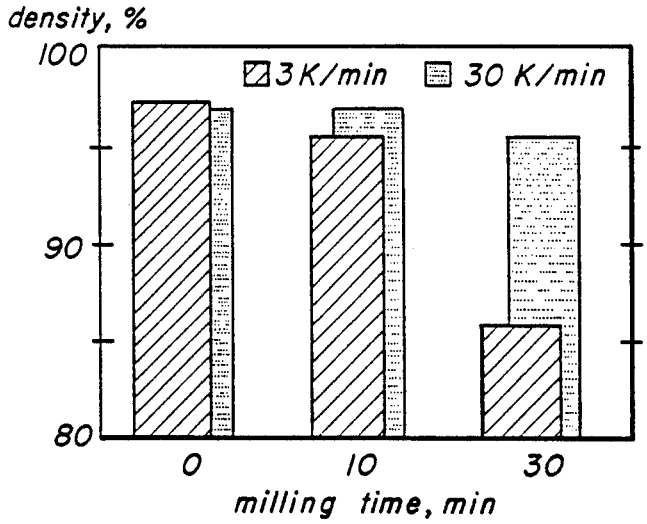
FIG. 4 is a bar graph showing sintered density (percent of theoretical) as a function of milling time and heating rate, based upon 3 μm Ni powder and 15 μm Al powder.

The effect of milling the powders was assessed using scanning electron microscopy. As noted in FIG. 2*b*, mechanical alloying with the high intensity mill resulted in agglomeration of the powder and appeared to have the greatest effect on the aluminum powder. The effect of milling time on the sintered density is shown in FIG. 4 using the 15 micrometer aluminum powder. For these experiments, two heating rates (3 and 30 K./min.) and three milling times (0, 10 and 30 min.) were evaluated. Sintering was conducted in vacuum for all of these cases. The unmilled powder achieved the highest density, over 97% of theoretical, and was relatively insensitive to the heating rate as compared to the milled powder. The milled powder showed an increase in density with the higher heating rate. Since the unmilled powder achieved the highest sintered density, further tests were conducted with unmilled powder.

Figure 5:
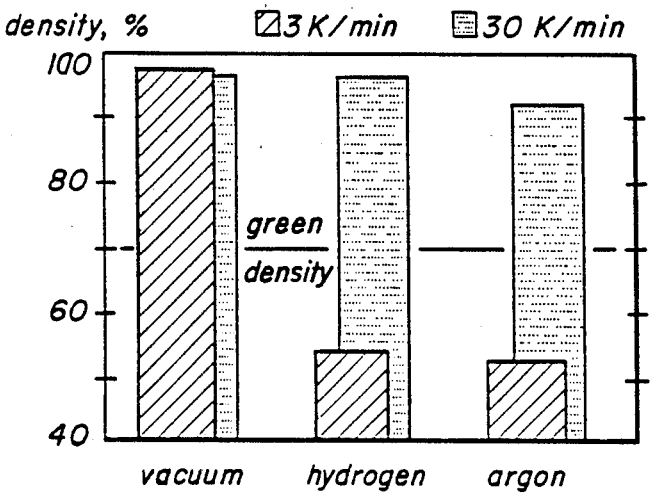
FIG. 5 is a bar graph showing sintered density (percent of theoretical) for two heating rates and three different atmospheres, as the case may be, for unmilled 3 μm Ni powder and 15 μm Al powder.

The atmosphere effect on sintered density is shown in FIG. 5, again using the 15 micrometer aluminum powder, in this case unmilled. With the 3 K./min. heating rate, the samples sintered in argon swelled, resulting in comparatively low sintered densities. At a heating rate of 30 K./min., densification occurred in all atmospheres, giving theoretical densities of 97.5% in vacuum, 96.4% in dry hydrogen and 93.1% in dry argon.

Figure 6:
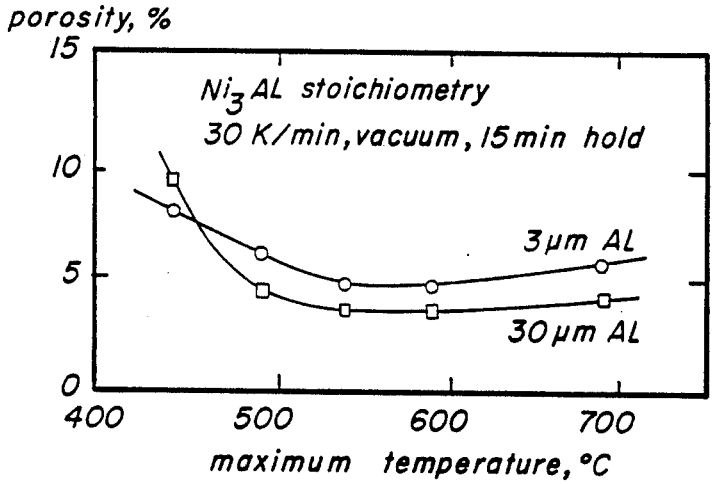
FIG. 6 is a graph showing the effect of the maximum sintering temperature on final porosity for two different aluminum particle sizes.

In light of the self-heating during the sintering reaction, experiments were performed to determine the maximum sintering temperature needed for densification. FIG. 6 shows example results for a 30 K./min. heating rate to various maximum sintering temperatures, with a subsequent 15 minute hold time at that sintering temperature using two aluminum particle sizes. Temperatures below 550° C. gave higher porosities, most likely because little or no liquid is formed. At temperatures in the 550° C. to 600° C. range there is good densification. With higher temperatures, there is a gradual swelling phenomenon. Thus, the optimal reaction temperature is unexpectedly relatively low. It will be noted that generally the 3 micrometer aluminum powder gives less densification than the 30 micrometer powder. Indeed, the 15 micrometer aluminum powder proved optimal as illustrated in FIG. 7.

Figure 7:
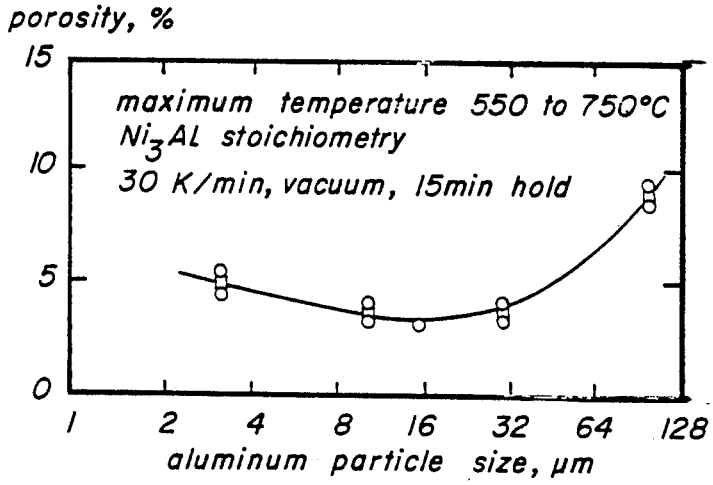
FIG. 7 is a graph of final porosity as a function of the aluminum particle size for various maximum sintering temperatures between 550° and 750° C.

FIG. 7 further demonstrates the aluminum particle size effect by showing the final porosity versus aluminum particle size for compacts sintered at temperatures ranging from 550° to 750° C. A particle size near 15 micrometer appears best, giving a final porosity less than 3%.

Figure 8:
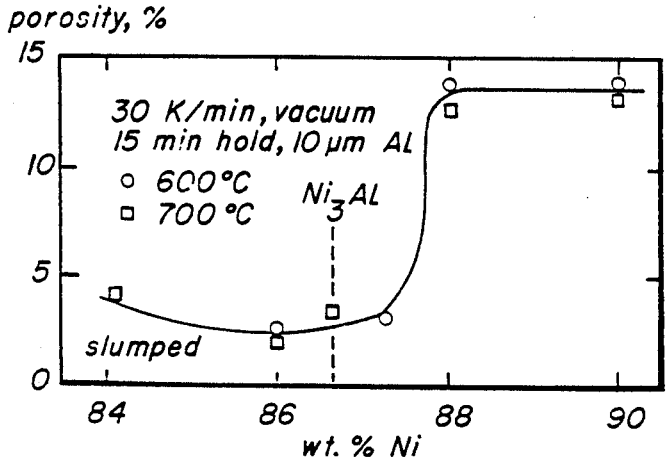
FIG. 8 is a graph showing the stoichiometry effect (in terms of the percent by weight of Ni) on porosity for reaction sintered compositions near $Ni_3Al$ using two maximum sintering temperatures.

All of the above discussed results are for a 3:1 atomic ratio of Ni to Al. Experiments were conducted to determine the stoichiometry effect using 10 micrometer aluminum powder. Maximum temperatures of 600° and 700° C. were employed along with a 15 minute hold time and 30 K./min. heating rate in vacuum. FIG. 8 shows the final porosity versus nickel content. A dramatic change in behavior exists near the intermetallic compound stoichiometry. It will be noted that the compacts slumped in the case of the highest aluminum content samples. Thus, the reactive sintering process appears best suited to compositions close to the $Ni_3Al$ stoichiometry.

Figure 9:
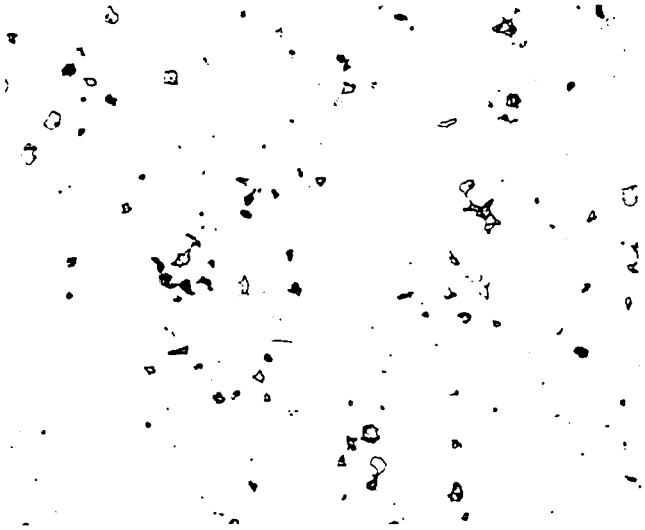
FIG. 9 is an optical micrograph of the unetched microstructure of a reaction sintered nickel aluminide in the assintered condition, shown at a scale of 100 μm.
Figure 10:
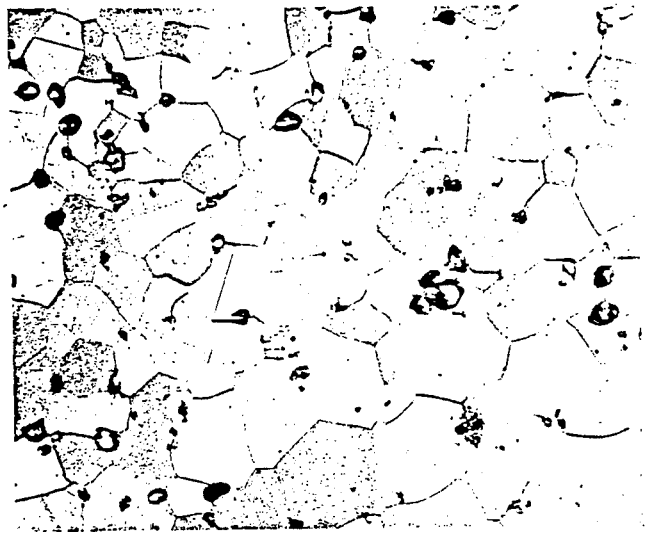
FIG. 10 is an optical micrograph of the etched microstructure of a reaction sintered nickel aluminide (etched with dilute Kelling's), in which the increase in apparent porosity is due to the etchant dissolving the second phase ($Ni_5Al_3$), shown at a scale of 100 μm.

The microstructure of a stoichiometric sample in the assintered condition is shown in FIG. 9. This sample was sintered in vacuum for 10 minutes at 750° C. using unmilled 15 micrometer aluminum powder with a heating rate of 30 K./min. The microstructure shows a small amount of porosity and two distinct phases. FIG. 10 shows the etched microstructure. The apparent increase in porosity between the samples of FIGS. 9 and 10 is due to the etchant selectively dissolving the second phase. In the etched condition the grain size is evident, which is approximately 30 micrometer. The bulk hardness was 52 HRA and the microhardness was measured as 264 Knoop (100 g load), which agrees favorably with a value of 240 measured on a hot isostatically compacted and extruded prealloyed powder compact.

Figure 11:
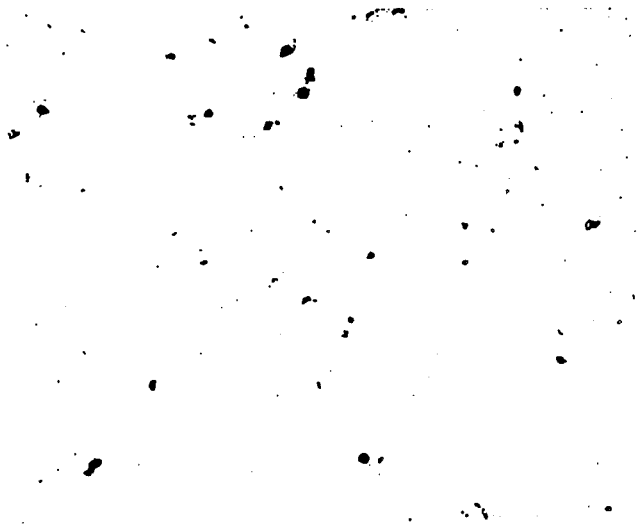
FIG. 11 is a schematic view of the polished microstructure of a reactive sintered nickel aluminide subjected to a post sintering anneal at 1350° C. for one hour, shown at a scale of 100 μm.

Chemical analysis after sintering gave the composition as 12.2% Al, 87.6% Ni (76.8 at.% Ni), with 0.02% Fe, 0.01% Si, 482 ppm 0 and 420 ppm C. Electron microprobe analysis was used to identify the two phases, giving $Ni_3Al$ as the major phase with an aluminum level of 24.3 at.%. The minor phase had an aluminum content of 34.8 at.%, approximately corresponding to the $Ni_5Al_3$ compound. Since the $Ni_5Al_3$ compound is unstable at high temperatures (see FIG. 1), the reactive sintered material was annealed at 1350° C. for one hour to attain homogenization. FIG. 11 shows the microstructure after such an anneal. As expected, there is no second phase. Microprobe line scans across the structure confirmed that the composition was uniform throughout the sample. Transmission electron microscopy substained that the product was ordered $Ni_3Al$.

Figure 12:
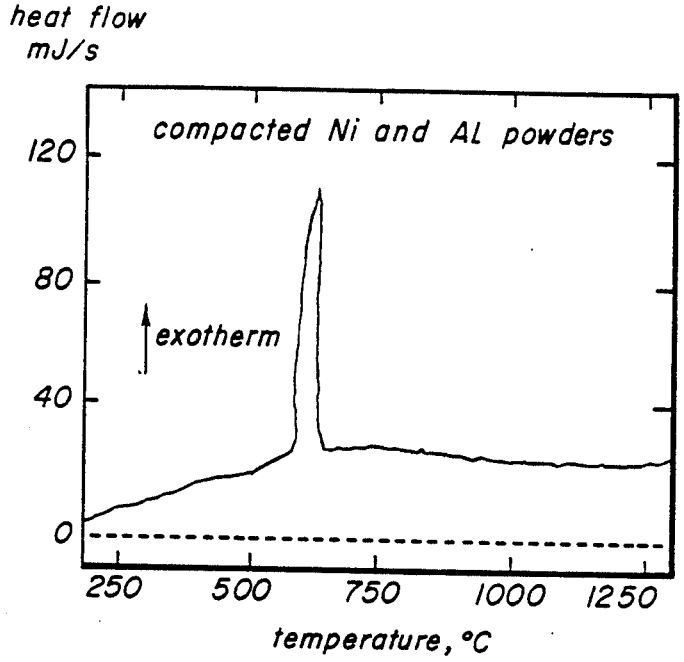
FIG. 12 is a graph of a differential thermal analysis scan for mixed nickel and aluminum unmilled powders (3 μm Ni, 15 μm Al), showing the reactive sintering exotherm at approximately 600° C.
Figure 13:
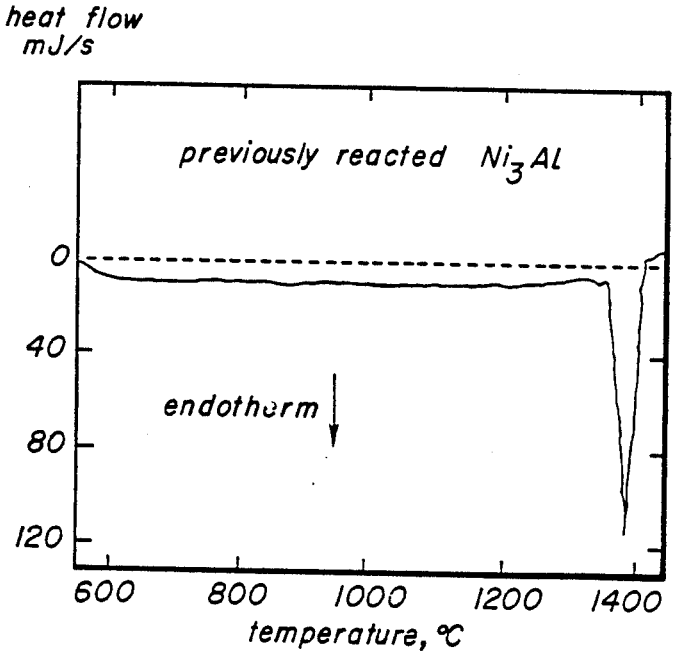
FIG. 13 is a graph of a differential thermal analysis scan on reacted nickel aluminide, showing no reactions until the melting endotherm at approximately 1385° C.

Differential thermal analysis and dilatometry were used to understand the character of the reactive sintering process. FIG. 12 shows a differential thermal analysis performed on the unmilled powder and FIG. 13 shows the equivalent experiment after reaction. In the unreacted powder a large exotherm is evident at approximately 580° to 600° C., demonstrating the onset of reactive sintering (FIG. 12). This is slightly higher than the temperature of 550° C. which gave good sintering results as shown in FIG. 6. In the reacted sample, no further exotherm and only an endotherm is evident when the sample melts, indicating total consumption of the ingredients in the reactive sintering process (FIG. 13).

The first eutectic temperature in the aluminum-nickel system (see FIG. 1) is at 640° C. and aluminum melts at 660° C. Thus, the exotherm (FIG. 12) which occurs prior to liquid formation and the compact undergoes self-heating, leading to rapid liquid formation. The dilatometry results correlated with the differential thermal analysis, indicating the reaction began at approximately 600° C. Furthermore, under optimal conditions the duration of the reaction appears to be approximately two seconds. Consequently, studies involving time at the maximum temperature have not proven useful.

In this regard, while the reaction appears to start at about 500° C., temperatures near about 550° C. are believed to be needed to form a liquid and maximize densification. Since the reaction is completed very quickly, apparently in only a couple of seconds, no further heating is really needed, yet the heating must be applied initially sufficiently to start the exothermic reaction so that the liquid can be generated at the corresponding eutectic temperature. Significantly, as earlier noted, because the $Ni_3Al$ intermetallic compound is very stable, it solidifies quickly from the liquid.

In connection with the successful development of reactive sintering for the fabrication of $Ni_3Al$, some mechanical property assessments were performed. The transverse rupture strength and tensile specimens were tested, giving strength estimates of 470 MPa (traverse rupture) and 230 MPa (tensile), which agree with the published values for unalloyed $Ni_3Al$ (see [3] W. M. Schulson, *Inter. J. Powder Met.*, supra; and [4] K. Vedula and J. R. Stephens, *Powder Metallurgy* 1986 *State of the Art*, supra). The samples were slightly ductile, with elongation being in the range of 1%. Without boron doping and considering the residual pores, these ductility levels are quite unexpected for as-sintered material. It is in fact a major surprise that the reactive sintered samples are ductile, since pure polycrystalline nickel aluminides are brittle. Furthermore, preliminary oxidation tests indicate good resistance up to 900° C.

A direct comparison of the influence of the wt. % of Ni on the porosity at the maximum sintering temperatures of 600° C. and 700° C., under constant conditions of no milling of the powders, 30 K./min. heating rate, 10 μm Al particle size, 300 MPa compaction pressure, vacuum environment, and 15 min. holding time, may be seen from the rearranged data of Examples 1-10 from Table 2 in a Table 2a.

TABLE 2a

| Ex. | Ni wt. % | Max. temp. °C. | Sintd. dens. g/cm$^3$ | Porosity % |
|---|---|---|---|---|
| 1 | 84.0 | 600 | 6.88 | 3.2 |
| 6 | " | 700 | 6.81 | 4.2 |
| 2 | 86.0 | 600 | 7.18 | 2.8 |
| 7 | " | 700 | 7.23 | 2.2 |
| 3 | 86.7 | 600 | 7.21 | 3.2 |
| 8 | 86.7 | 700 | 7.25 | 3.3 |
| 4 | 88.0 | 600 | 6.49 | 13.5 |
| 9 | " | 700 | 6.58 | 12.7 |
| 5 | 90.0 | 600 | 6.56 | 13.8 |
| 10 | " | 700 | 6.56 | 13.8 |

A direct comparison of the influence of the Al particle size on the porosity at the various maximum sintering temperatures, under constant conditions of no milling of the powders, 86.7 wt. % Ni, 30 K./min. heating rate, 300 MPa compaction pressure, vacuum environment, and 15 min. holding time, may be seen from the rearranged data of Examples 11-30 from Table 2 in Table 2b.

TABLE 2b

| Ex. | Max. temp. °C. | Al part. size | Sintd. dens. g/cm$^3$ | Porosity % |
|---|---|---|---|---|
| 11 | 450 | 3 | 6.90 | 8.0 |
| 15 | 500 | " | 7.05 | 6.0 |
| 19 | 550 | " | 7.16 | 4.5 |
| 23 | 600 | " | 7.15 | 4.7 |
| 27 | 700 | " | 7.12 | 5.1 |
| 12 | 450 | 10 | 6.67 | 11.1 |
| 16 | 500 | " | 7.15 | 4.7 |
| 20 | 550 | " | 7.26 | 3.2 |
| 24 | 600 | " | 7.21 | 3.9 |
| 28 | 700 | " | 7.25 | 3.3 |
| 13 | 450 | 30 | 6.81 | 9.2 |
| 17 | 500 | " | 7.19 | 4.1 |
| 21 | 550 | " | 7.25 | 3.3 |
| 25 | 600 | " | 7.25 | 3.3 |
| 29 | 700 | " | 7.22 | 3.7 |
| 14 | 450 | 95 | 6.45 | 14.0 |
| 18 | 500 | " | 6.47 | 13.7 |
| 22 | 550 | " | 6.85 | 8.7 |
| 26 | 600 | " | 6.81 | 9.2 |
| 30 | 700 | " | 6.80 | 9.3 |

A direct comparison of the influence of the milling time on the porosity at different heating rates, under constant conditions of 86.7 wt. % Ni, 750° C. maximum temperature, 15 μm Al particle size, 330 MPa compaction pressure, vacuum environment, and 10 min. holding time, may be seen from the rearranged data of Examples 31-36 from Table 2 in Table 2c.

TABLE 2c

| Ex. | Mill. min. | Ht. rate K/min. | Sintd. dens. g/cm$^3$ | Porosity % |
|---|---|---|---|---|
| 31 | 0 | 3 | 7.31 | 2.5 |
| 33 | 10 | " | 7.15 | 4.7 |
| 35 | 30 | " | 6.43 | 14.3 |
| 32 | 0 | 30 | 7.30 | 2.7 |
| 34 | 10 | " | 7.29 | 2.8 |
| 36 | 30 | " | 7.16 | 4.5 |

A direct comparison of the influence of the environment or atmosphere on the porosity at different heating rates, under constant conditions of no milling of the powders, 86.7 wt. % Ni, 750° C. maximum temperature, 15 μm Al particle size, 330 MPa compaction pressure, and 10 min. holding time, may be seen from the rearranged data of Examples 31-32 and 37-40 from Table 2 in Table 2d.

TABLE 2d

| Ex. | Ht. rate K/min. | Atmos. type | Sintd. dens. g/cm$^3$ | Porosity % |
|---|---|---|---|---|
| 31 | 3 | vacuum | 7.31 | 2.5 |
| 37 | " | hydrogen | 4.05 | 46. |
| 39 | " | argon | 3.98 | 47. |
| 32 | 30 | vacuum | 7.30 | 2.7 |
| 38 | " | hydrogen | 7.23 | 3.6 |
| 40 | " | argon | 6.98 | 6.9 |

A direct comparison of the influence of the pertinent process parameters, i.e. (1) particle size of the aluminum powder, (2) stoichiometry, Ni wt.%, (3) milling time, (4) green density or compaction pressure, (5) maximum sintering temperature, (6) heating rate, (7) atmosphere or environment, and (8) duration of the sintering time, i.e. holding time once the exothermic reaction has been initiated, may be seen from the data of Examples 1-40 of Table 2 rearranged in order of sintered density and percent porosity as set forth in Table 3.

TABLE 3

$Ni_3Al$ Reactive Sintering Results

| Ex. | Milling min. | Ni wt. % | Heating rate K/min. | Max. temp. °C. | Al particle size μm | Compaction pres. MPa | Atmosphere type | Hold time min. | Sintered density g/cm³ | Porosity % |
|---|---|---|---|---|---|---|---|---|---|---|
| 31** | 0 | 86.7 | 3 | 750 | 15 | 330 | vacuum | 10 | 7.31 | 2.5 |
| 32** | " | " | 30 | " | " | " | " | " | 7.30 | 2.7 |
| 34** | 10 | " | " | " | " | " | " | " | 7.29 | 2.8 |
| 20* | 0 | " | " | 550 | 10 | 300 | " | 15 | 7.26 | 3.2 |
| 8* | " | " | " | 700 | " | " | " | " | 7.25 | 3.3 |
| 28* | " | " | " | " | " | " | " | " | 7.25 | 3.3 |
| 21* | " | " | " | 550 | 30 | " | " | " | 7.25 | 3.3 |
| 25* | " | " | " | 600 | " | " | " | " | 7.25 | 3.3 |
| 7* | " | 86.0 | " | 700 | 10 | " | " | " | 7.23 | 2.2 |
| 38** | " | 86.7 | " | 750 | 15 | 330 | H | 10 | 7.23 | 3.6 |
| 29* | " | " | " | 700 | 30 | 300 | vacuum | 15 | 7.22 | 3.7 |
| 3* | " | 86.7 | " | 600 | 10 | " | " | " | 7.21 | 3.2 |
| 24* | " | 86.7 | " | " | " | " | " | " | 7.21 | 3.9 |
| 17* | " | " | " | 500 | 30 | " | " | " | 7.19 | 4.1 |
| 2* | " | 86.0 | " | 600 | 10 | " | " | " | 7.18 | 2.8 |
| 19* | " | 86.7 | " | 550 | 3 | " | " | " | 7.16 | 4.5 |
| 36** | 30 | " | " | 750 | 15 | 330 | " | 10 | 7.16 | 4.5 |
| 16* | 0 | " | " | 500 | 10 | 300 | " | 15 | 7.15 | 4.7 |
| 23* | " | " | " | 600 | 3 | " | " | " | 7.15 | 4.7 |
| 33** | 10 | " | 3 | 750 | 15 | 330 | " | 10 | 7.15 | 4.7 |
| 27* | 0 | " | 30 | 700 | 3 | 300 | " | 15 | 7.12 | 5.1 |
| 15* | " | " | " | 500 | " | " | " | " | 7.05 | 6.0 |
| 40** | " | " | " | 750 | 15 | 330 | Ar | 10 | 6.98 | 6.9 |
| 11* | " | " | " | 450 | 3 | 300 | vacuum | 15 | 6.90 | 8.0 |
| 1* | " | 84.0 | " | 600 | 10 | " | " | " | 6.88 | 3.2 |
| 22* | " | 86.7 | " | 550 | 95 | " | " | " | 6.85 | 8.7 |
| 6* | " | 84.0 | " | 700 | 10 | " | " | " | 6.81 | 4.2 |
| 13* | " | 86.7 | " | 450 | 30 | " | " | " | 6.81 | 9.2 |
| 26* | " | " | " | 600 | 95 | " | " | " | 6.81 | 9.2 |
| 30* | " | " | " | 700 | " | " | " | " | 6.80 | 9.3 |
| 12* | " | " | " | 450 | 10 | " | " | " | 6.67 | 11.1 |
| 9* | " | 88.0 | " | 700 | " | " | " | " | 6.58 | 12.7 |
| 5* | " | 90.0 | " | 600 | " | " | " | " | 6.56 | 13.8 |
| 10* | " | 90.0 | " | 700 | " | " | " | " | 6.56 | 13.8 |
| 4* | " | 88.0 | " | 600 | " | " | " | " | 6.49 | 13.5 |
| 18* | " | 86.7 | " | 500 | 95 | " | " | " | 6.47 | 13.7 |
| 14* | " | " | " | 450 | " | " | " | " | 6.45 | 14.0 |
| 35** | 30 | " | 3 | 750 | 15 | 330 | " | 10 | 6.43 | 14.3 |
| 37** | 0 | " | 3 | " | " | " | H | " | 4.05 | 46. |
| 39** | " | " | 3 | " | " | " | Ar | " | 3.98 | 47. |

*compaction pressure = 300 MPa; holding time = 15 min.
**compaction pressure = 330 MPa; holding time = 10 min.

It will be seen from the foregoing that the reactivity of the nickel and aluminum powders results in relatively high sintered densities with low apparent sintering temperatures and short sintering times. The high final densities indicate that a liquid is present during a portion of the sintering cycle. Processing conditions which influence the reaction between the constituent powders will alter the amount of liquid, length of time the liquid is present and its distribution in the microstructure. In transient liquid phase sintering, the liquid quantity, distribution and duration are considered to dictate the final sintered density and mechanical properties (see [8] W. S. Baek and R. M. German, *Inter. J. Powder Met.*, supra, and [9] *Powder Met. Inter.*, supra; and [10] R. M. German and J. W. Dunlap, *Metall. Trans. A.*, supra).

However, unlike other sintering studies, according to the present invention the time at sintering temperature is not a significant factor since the process occurs surprisingly rapidly once the liquid forms (cf. FIG. 12). In large part, the role of the various above noted process parameters appear to be explained in terms of their effects on the liquid phase.

It is believed that the milling of the powders decreased the sintering density herein because in all probability the liquid formed discontinuously in the microstructure and persisted for too short a time. Also, it is believed that an increase in the aluminum-nickel interfacial area due to milling will lead to more solid state interdiffusion during the heating, thereby reducing the amount of liquid during the reaction. The milling effect is related to particle size and heating rate as shown in FIG. 4.

Possibly, with milling the liquid is consumed faster during sintering, and may be diminished by more solid state interdiffusion prior to liquid formation, a concept which is substained by the particle size experiments as shown in FIG. 7. A small aluminum particle size gives more rapid reaction, based on more interfacial area, and less densification, whereas a coarse aluminum powder gives a poor distribution of the liquid in the microstructure.

At the stoichiometric composition, aluminum constitutes 34 vol.% of the solid structure. This is insufficient to form an interconnected network of aluminum unless the aluminum particle size is less than the nickle particle size (see [6] R. M. German, *Liquid Phase Sintering*, supra). In the green compact, the nickel agglomerates are approximately 30 micrometer in intercept length, corresponding to a 45 micrometer diameter.

It has been indicated (see [20] D. M. Biggs, *Metal-Filled Polymers*, S. K. Bhattacharya (ed.), Marcel Dekker, New York, NY, 1986, pp. 165–226) that a particle size ratio of at least 2.4:1 (major phase diameter to minor phase diameter) is required at 34 vol.% to form a connected network in the minor phase. Thus, for 45 micrometer nickel agglomerates, an aluminum particle size of approximately 19 micrometer, or smaller, is required. With respect to FIG. 7, the optimal particle size for the aluminum (15 micrometer) was in agreement with this value. Thus, it appears that a connected aluminum matrix with minimal interfacial area is required for optimal densification.

Similar concepts are recognized in persistent liquid phase sintering, where the dispersion of the liquid throughout the microstructure greatly aids densification (see [6] R. M. German, *Liquid Phase Sintering,* supra). Such a concept helps explain the negative effect of milling as found herein. The nickel particles are initially agglomerated, such that milling probably decreases the nickel particle size, thereby disrupting the aluminum connectivity.

The sintering atmosphere role in determining the sintered density is believed to be explained by heat conduction and entrapped gas effects. Heat is carried away from the compact during reaction by the higher thermal conductivity of a gas such as hydrogen or argon versus vacuum. Furthermore, because of the speed of the reaction, there is no time for the gaseous atmosphere captured in the pores of the compact to escape. Hydrogen has a higher solubility in $Ni_3Al$ than argon. Thus, with hydrogen in the pores there is some opportunity for gas escape even after the pores have sealed during densification. A study of FIG. 5 indicates that indeed hydrogen led to better results than argon at both heating rates tested, yet use of a vacuum was superior to both such gases.

It should be noted that, in the past, heating rate effects on transient liquid phase sintering have been explained on the basis of solid state interdiffusion prior to liquid formation ([8] W. S. Baek and R. M. German, *Inter. J. Powder Met.,* supra, and [9] *Powder Met. Inter.,* supra; and [10] R. M. German and J. W. Dunlap, *Metall. Trans. A.,* supra). With a slow heating rate there in more solid state reaction with subsequently less liquid. Indeed, the intermetallic products from solid state interdiffusion may actually inhibit liquid formation at the reaction temperature.

Typically, higher heat rates are beneficial when sintering involves a transient liquid. However, there is a limit to the benefit of rapid heating rates. Too rapid a heating rate gives a loss of process control, and with massive samples proves difficult to sustain with any uniformity. Additionally, as the heating rate increases, the reactivity of the liquid likewise increases, thereby decreasing its duration. Hence, again intermediate heating rates appear to prove most reasonable. In this area of investigation, it is not believed that very rapid heating has yet been reported.

It appears that a temperature of only about 550° C. or more is required herein to react optimally nickel and aluminum powders. Higher temperatures, e.g. than about 700° or 750° C., do not appear to be of benefit since the reaction is fairly complete in short times as soon as a temperature near 600° C. is attained (see FIG. 12). The calculated maximum 150 K. heating from the exothermic reaction is sufficient to attain the 640° C. eutectic from such a temperature of only about 550° C. Thus, the reaction appears to be spontaneous during the heating, independent of the final temperature and hold time. Accordingly, while sintering temperatures above about 750° C. may be used, in the interests of efficiency and economy the sintering temperature actually used herein is preferably at most about 750° C. The heating rate appears to be important only in its effect on the interdiffusion prior to the reaction.

Likewise, the particle size appears to be of importance in determining the distribution of the liquid in the microstructure. If the liquid forms in isolated pools, then no long range capillary action is possible and swelling is to be expected (see [6] R. M. German, *Liquid Phase Sintering,* supra; [8] W. S. Baek and R. M. German, *Inter. J. Powder Met.,* and [9] *Powder Met. Inter.,* supra; [10] R. M. German and J. W. Dunlap, *Metall. Trans. A.,* supra; and [21] D. J. Lee and R. M. German, *Inter. J. Powder Met. Powder Tech.,* 1984, vol. 20, pp. 9–21). Alternatively, a connected aluminum matrix will lead to rapid densification because of the long range capillary action.

This concept also helps to explain the stoichiometry results. With an excess of aluminum there is more liquid and an excess over that required to form $Ni_3Al$. The final porosity is fairly constant with an excess of aluminum, but slumping and shape loss are observed at 84% Ni. On the other hand, an excess of nickel reduces the amount of liquid and decreases the aluminum connectivity, thereby separating the liquid pools within the compact. For the tests shown in FIG. 8 with a 10 micrometer aluminum powder, the calculated loss of connectivity for the aluminum would appear to occur between 87 and 90 wt.% Ni, in agreement with the experimental observation. As a consequence, the high nickel content compositions fail to densify optimally because of the presence of less liquid and a decreased connectivity of aluminum in the microstructure.

The composition of the second phase in the as-sintered compacts correspond to $Ni_5Al_3$. This compound is stable over the approximate composition range of 32 to 37 at.% aluminum (see [19] I. M. Robertson and C. M. Wayman, *Metallog.,* supra), which agrees with the determination herein of 34.8 at.% Al. The one hour heat treatment at 1350° C. effectively dissolves this phase, leaving the equilibrium compound $Ni_3Al$. The formation of the $Ni_5Al_3$ phase would seem to indicate that the reaction is not directly from nickel and aluminum to $Ni_3Al$, but involves formation of intermediate compounds. Removal of the residual porosity can be facilitated by hot isostatic compaction, as is herein demonstrated. With sintered densities of over 92% of theoretical, the pore structure consists of closed pores (see [22] R. M. German, *Powder Metallurgy Science,* Metal Powder Industries Federation, Princeton, NJ, 1984, pp. 168–171), and this offers the possibility to utilize containerless hot isostatic compaction to achieve full density.

In connection with the foregoing, it will be noted that besides the main reactive sintering process described above, tests have also been conducted using hot isostatic compaction to form dense $Ni_3Al$. In accordance with this alternative counterpart embodiment, the same type mixed elemental nickel and aluminum powders as noted above are cold isostatically compacted and loaded into containers, e.g. stainless steel containers, which are then welded closed after being evacuated to provide a vacuum environment or atmosphere therein, and the closed containers are then simultaneously heated and pressurized in a hot isostatic press at a maximum sintering temperature of for instance 750° C. for a hold time at that temperature of for instance 30 minutes and under a pressure of for instance approximately 100 MPa. The resulting material from such hot isostatic sintering is fully densified and in a form convenient for fabricating tensile samples for strength measurement testing, and optionally contemplates additive ingredient doped samples such boron doped samples, as in the case of the main embodiment herein.

In connection with this alternative counterpart embodiment, it will be realized that the contemplated hot isostatic sintering process is carried out generally in observance of all of the foregoing pertinent process parameters as to cold compaction pressure, sintering temperature, heating rate, wt. % Ni content, nickel and aluminum powder particle sizes, etc., being distinguished from the main reactive sintering process by the effecting of the sintering in a vacuum and under mechanical pressure or force, whereby to achieve essentially fully densified products of little or no porosity, since the mechanical pressure applied during the sintering reaction aids in eliminating the final small percent of porosity otherwise remaining.

Specifically, this alternative counterpart embodiment advantageously permits full density to be achieved at very low mechanical pressures applied during the reaction, since the liquid generated upon initiation of the exothermic reaction under the sealed container vacuum conditions offers near zero strength in the sealed compact during the reaction. Hence, any appropriately low mechanical pressure, e.g. about 100 MPa, will assure effective closure of the residual pores in the compact. Moreover, any appropriate substantially dry inert negative pressure environment is usable as distinguished from a vacuum per se.

It will be realized that since the product is of varying porosity depending on the above stated main process parameters (1) to (8), the most useful combinations appear to be those leading to a product having a final porosity of about 8% or less. In these cases, the pores are not open but closed and isolated. Consequently, the compact can then be fully densified in any of several conventional secondary processes at relatively low cost, including subsequent containerless hot isostatic compaction as earlier noted. On the other hand, if the product in fact has a final porosity greater than about 8%, it may instead be desirably sealed in a container to attain full consolidation, since if not, gas may penetrate the pores open to or exposed to the external surface and prevent densification.

Hence, unless the instant alternative counterpart embodiment technique is used to attain forthwith essentially full densification, the combination of said main process parameters should be used according to the main embodiment of the present invention so as to achieve a final porosity after reaction of preferably below about 8% or such subsequent conventional processing will be needed to achieve a corresponding product of little or no residual porosity.

It will thus be appreciated that the low temperature reactive sintering process according to the present invention, including the main process embodiment as well as the alternative counterpart sealed container hot isostatic compacting embodiment, is applicable to intermetallic compounds in general. Advantageously, the elemental powders primarily contemplated herein are relatively inexpensive, widely available, easily mixed in different ratios to adjust the desired composition, can be alloyed using other additives, including boron to provide boron doped compositions, and/or chromium and/or hafnium and/or iron to provide corresponding compositions, in appropriate ratios to adjust the desired composition, and are easily die compacted since they are favorably soft in contrast to prealloyed powders alone. The low processing temperature of preferably about 550° to 750° C. contributes to the novel nature of the produced material, since nickel aluminide is considered to be a high temperature material, i.e. having a melting temperature near 1400° C. The processing time is unusually short, amounting to about one half hour total time. The product is densified and exhibits good strength and unexpectedly some ductility in spite of the residual porosity. It retains the properties of strength and ductility even after subsequent high temperature exposures. This contrasts with prealloyed nickel aluminides which require powder atomization from the melt, are very difficult to consolidate, necessarily need alloying additions to attain any significant ductility at all and necessarily require expensive, complex and/or multiple processing steps which may include hot isostatic compaction among them.

Hence, according to the present invention, by applying low temperature reactive sintering to the fabrication of $Ni_3Al$ using mixed elemental powders, densities in excess of 97% of theoretical are achievable through appropriate selection of particle sizes, composition, green density, heating rate, atmosphere, maximum sintering temperature and hold time. Clearly, the sintered density depends on the amount of liquid formed at the first eutectic temperature and the connectivity of this liquid. In this sense, reactive sintering is analogous to transient liquid phase sintering. Because the liquid persists for only a short time, it is important that the several process parameters noted earlier herein be attentively controlled to optimize the sintered density. Subsequent processing such as heat treatment and containerless hot isostatic compaction can be used conveniently to remove the residual porosity and homogenize the compact. A key to success per the present invention is the formation of a fully interconnected liquid phase. This dictates the amount and particle size distribution of the constituents needed for optimal densification. The produced material is readily usable as an intermetallic compound and in providing metal-matrix composites, especially for high temperature applications.

Accordingly, the present invention provides for the production of the nickel aluminide $Ni_3Al$ intermetallic compound in a unique ordered form permitting its use as a high performance, high temperature material, especially as a matrix for high temperature composites, by a unique relatively low temperature and short duration reactive sintering process which involves the exothermic formation of the compound from the constituent powders under favorable processing effects as to microstructure and properties, and leading to a dense, somewhat ductile, strong and oxidation resistant product.

Such production lends itself to incorporation of various additional phase ingredients such as ceramic particles, whiskers and fibers in the nickel aluminide matrix, for instance by inclusion in the green compact of ceramic particles, silicon carbide whiskers, ceramic fibers, etc. in various ratios to adjust the desired composition, e.g. by injection molding technique, for attendant in situ reaction with the base matrix, especially in complex shape matrix mass compacts, under the contemplated comparatively low processing temperatures and short duration reaction times of the main reactive sintering embodiment, to minimize any potential difficulties traceable to thermal expansion mismatches and interfacial interactions, plus optional subsequent hot isostatic compaction for final densification of the structure, or per the alternative embodiment under the contemplated analogous conditions thereof.

Also, further phase ingredients may be included in the composition material according to the present invention, such as alloying additions to improve the properties of the basic $Ni_3Al$ intermetallic compound material, and particularly boron, e.g. up to about 1%, to improve ductility, chromium, e.g. up to about 5%, to improve oxidation and corrosion resistance, hafnium, e.g. up to about 2%, to improve high temperature creep resistance, and iron, e.g. up to about 10%, to improve mechanical strength and ductility, generally provided as elemental fine particle constituents admixed into the composition forming the green compact, or optionally by prealloying with the nickel component used herein.

The contemplated reactive sintered nickel aluminide products produced in accordance with the present invention are accordingly strong, slightly ductile, nearly fully or optionally essentially fully densified structures containing the ordered intermetallic compound $Ni_3Al$, which resist embrittlement on high temperature exposure, and are therefore suitable for use as turbine components, automotive cylinder liners, structural composite matrices, dental instruments, medical tools, wear facing parts, corrosion protection elements, and the like.

While specific embodiments of the invention have been shown and described in detail to illustrate the application of the principles of the invention, it will be understood that the invention may be embodied otherwise without departing from such principles.

What is claimed is:

1. Reactive sintering process for producing a shaped body of the nickel aluminide compound $Ni_3Al$, which comprises sintering a compacted shaped mass containing an intimate mixture of elemental nickel powder and elemental aluminum powder in a stoichiometric atomic ratio generally corresponding to the compound $Ni_3Al$, by heating the mass in a substantially dry inert atmosphere to an elevated sintering temperature sufficiently to initiate an exothermic reaction, and at a heating rate sufficiently for consequent progressive generation of a transient liquid below the melting point of the aluminum powder and at the corresponding eutectic temperature, and upon initiation of the exothermic reaction continuing the sintering for a total sintering time of at least about 2 seconds and sufficiently to form a densified shaped body containing the nickel aluminide compound $Ni_3Al$ having a porosity of at most about 8%.

2. Process of claim 1 wherein the mass is heated to a sintering temperature of at most about 750° C.

3. Process of claim 1 wherein the mass is heated to a sintering temperature of about 550°–750° C.

4. Process of claim 1 wherein the mass is heated at a heating rate of about 3–30 K./min.

5. Process of claim 1 wherein the nickel powder is present in an amount of about 84.0–88.0 wt.% of the mixture.

6. Process of claim 1 wherein the nickel powder is present in an amount of about 86.0–87.3 wt% of the mixture.

7. Process of claim 1 wherein the nickel powder is present in a particle size of about 3 μm and the aluminum powder is present in a particle size of about 3–30 μm.

8. Process of claim 1 wherein upon initiation of the exothermic reaction the sintering is continued for a holding time of at most about 10–15 minutes.

9. Process of claim 1 wherein the inert atmosphere is a vacuum, dry hydrogen, or argon.

10. Process of claim 1 wherein the mass has been compacted at a compaction pressure of at least about 100 MPa.

11. Process of claim 1 wherein the nickel powder and aluminum powder comprise unmilled particles.

12. Process of claim 1 wherein the nickel powder and aluminum powder comprise particles which have been milled to form agglomerated clusters.

13. Process of claim 1 wherein the total sintering time is at most about one half hour.

14. Process of claim 1 wherein the particle size of the nickel powder is operatively equal to or greater than the particle size of the aluminum powder in the compacted shaped mass.

15. Process of claim 1 wherein at least one additional phase material is incorporated in the compacted shaped mass.

16. Process of claim 15 wherein the additional phase material includes at least one of ceramic particles, whiskers or fibers.

17. Process of claim 15 wherein the additional phase material includes at least one alloying ingredient.

18. Process of claim 17 wherein the alloying ingredient includes at least one of boron, chromium, hafnium and iron.

19. Process of claim 18 wherein the alloying ingredient is in the form of elemental metal fine particles.

20. Process of claim 18 wherein the alloying ingredient is in the form of fine particles of a prealloy of the alloying ingredient with nickel.

21. Process of claim 1 wherein the densified shape body is recovered and thereafter annealed by heat treatment in a substantially dry inert atmosphere to homogenize further the corresponding microstructure thereof.

22. Reactive sintering process for producing a shaped body of the nickel aluminide compound $Ni_3Al$, which comprises sintering a compacted shaped mass of an initmate mixture of unmilled elemental nickel powder in a particle size of less than about 3 μm and unmilled elemental aluminum powder in a particle size of about 15 μm, in a stoichiometric atomic ratio generally corresponding to the compound $Ni_3Al$ and in which the nickel powder is present in an amount of about 85.5–87.5 wt.% of the mixture, by heating the mass in a substantially dry inert atmosphere to an elevated sintering temperature of about 550°–750° C. sufficiently to initiate an exothermic reaction, and at a heating rate of at least 3 K./min. for consequent progressive generation of a transient liquid below the melting point of the aluminum powder and at the corresponding eutectic temperature, and upon initiation of the exothermic reaction continuing the sintering for a total sintering time of at least about 2 seconds and at most about 10–15 minutes, to form a densified shaped body containing the nickel aluminide compound $Ni_3Al$ having a porosity of less than about 8%.

23. Shaped body produced by the process of claim 1.

24. Shaped body produced by the process of claim 22.

25. Shaped body of claim 23 wherein said body contains ordered $Ni_3Al$ and is ductile, having an elongation in the range of about 1%.

26. Shaped body of claim 24 wherein said body contains ordered $Ni_3Al$ and is ductile, having an elongation in the range of about 1%.

27. Hot isostatic reactive sintering process for producing a fully dense shaped body of the nickel aluminide compound $Ni_3Al$, which comprises cold isostatically compacting an intimate mixture of elemental nickel powder and elemental aluminum powder in a stoichiometric atomic ratio generally corresponding to the compound $Ni_3Al$ to form a compacted shaped mass, sealing the compacted shaped mass in a container which has been evacuated to form a sealed container containing the compacted shaped mass under vacuum, and hot isostatically compacting the mass by simultaneously heating and pressing the sealed container sufficiently to initiate an exothermic reaction and generate a transient liquid below the melting point of the aluminum powder and at the corresponding eutectic temperature, and upon initiation of the exothermic reaction continuing the heating and pressing sufficiently to form a fully densified shaped body containing the nickel aluminide compound $Ni_3Al$.

28. Process of claim 27 wherein the mass is heated to a sintering temperature of at most about 750° C.

29. Process of claim 27 wherein the mass is heated to a sintering temperature of about 550°–750° C.

30. Process of claim 27 wherein the mass is heated at a heating rate of about 3–30 K./min.

31. Process of claim 27 wherein the nickel powder is present in an amount of about 84.0–88.0 wt.% of the mixture.

32. Process of claim 27 wherein the nickel powder is present in an amount of about 86.0–87.3 wt.% of the mixture.

33. Process of claim 27 wherein the nickel powder is present in a particle size of about 3 μm and the aluminum powder is present in a particle size of about 3–30 μm.

34. Process of claim 27 wherein the mass has been cold compacted at a compaction pressure of at least about 100 MPa.

35. Process of claim 27 wherein the nickel powder and aluminum powder comprise unmilled particles.

36. Process of claim 27 wherein the nickel powder and aluminum powder comprise particles which have been milled to form agglomerated clusters.

37. Process of claim 27 wherein the particle size of the nickel powder is operatively equal to or greater than the particle size of the aluminum powder in the compacted shaped mass.

38. Process of claim 27 wherein at least one additional phase material is incorporated in the compacted shaped mass.

39. Process of claim 38 wherein the additional phase material includes at least one of ceramic particles, whiskers of fibers.

40. Process of claim 38 wherein the additional phase material includes at least one alloying ingredient.

41. Process of claim 40 wherein the alloying ingredient includes at least one of boron, chromium, hafnium and iron.

42. Process of claim 41 wherein the alloying ingredient is in the form of elemental metal fine particles.

43. Process of claim 41 wherein the alloying ingredient is in the form of fine particles of a prealloy of the alloying ingredient with nickel.

44. Process of claim 27 wherein the container is a stainless steel container which is sealed by welding.

45. Process of claim 27 wherein the container is heated to a temperature of about 750° C. and pressed under a mechanical force of about 100 MPa for a holding time of about one half hour.

46. Shaped body produced by the process of claim 27.

47. Process which comprises sintering a compacted shaped mass of an intimate mixture including powder particles containing nickel and powder particles of elemental aluminum in a stoichiometric atomic ratio of the nickel and aluminum in the mixture generally corresponding to the compound $Ni_3Al$, by heating the mass in a substantially dry inert negative pressure environment to an elevated sintering temperature sufficiently to initiate an exothermic reaction and generate a transient liquid below the melting point of the aluminum and at the corresponding eutectic temperature, and upon initiation of the exothermic reaction continuing the heating sufficiently to form a densified shaped body containing the nickel aluminide compound $Ni_3Al$.

48. Process of claim 47 wherein the heating is carried out without applying mechanical pressure to the mass, whereby to form a densified shaped body having a porosity of at most about 8%.

49. Process of claim 47 wherein the heating is carried out under simultaneously applied mechanical pressure for hot isostatic compaction of the mass, whereby to form a fully densified shaped body.

50. Shaped body produced by the process of claim 47.

* * * * *